US009368896B2

(12) United States Patent
Suzuki et al.

(10) Patent No.: US 9,368,896 B2
(45) Date of Patent: Jun. 14, 2016

(54) CONNECTOR

(71) Applicant: Yazaki Corporation, Minato-ku, Tokyo (JP)

(72) Inventors: Kenji Suzuki, Makinohara (JP); Hiroshi Miyazaki, Tokyo (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/585,910

(22) Filed: Dec. 30, 2014

(65) Prior Publication Data

US 2015/0111441 A1 Apr. 23, 2015

Related U.S. Application Data

(63) Continuation of application No. PCT/JP2013/070230, filed on Jul. 25, 2013.

(30) Foreign Application Priority Data

Jul. 25, 2012 (JP) ..... 2012-165185

(51) Int. Cl.
*H01R 13/422* (2006.01)
*H01R 13/436* (2006.01)
*H01R 13/629* (2006.01)

(52) U.S. Cl.
CPC ..... *H01R 13/4226* (2013.01); *H01R 13/4223* (2013.01); *H01R 13/4365* (2013.01); *H01R 13/62938* (2013.01)

(58) Field of Classification Search
USPC ..... 439/595, 489, 752, 345
See application file for complete search history.

(56) References Cited

U.S. PATENT DOCUMENTS

| | | | | |
|---|---|---|---|---|
| 4,969,841 | A | 11/1990 | Sueyoshi et al. | |
| 5,645,452 | A * | 7/1997 | Kodama | 439/595 |
| 6,244,900 | B1 * | 6/2001 | Ishikawa et al. | 439/595 |
| 6,626,701 | B2 * | 9/2003 | Yoshida et al. | 439/595 |
| 6,669,507 | B2 * | 12/2003 | Yamanashi et al. | 439/595 |
| 6,796,836 | B2 * | 9/2004 | Ichida et al. | 439/595 |
| 6,811,437 | B2 * | 11/2004 | Nimura | 439/595 |

(Continued)

FOREIGN PATENT DOCUMENTS

| | | |
|---|---|---|
| CN | 1245986 A | 3/2000 |
| CN | 1665074 A | 9/2005 |

(Continued)

OTHER PUBLICATIONS

International Search Report dated Oct. 1, 2013 issued in International Application No. PCT/JP2013/070230 (PCT/ISA/210).

(Continued)

*Primary Examiner* — Alexander Gilman
(74) *Attorney, Agent, or Firm* — Sughrue Mion, PLLC

(57) ABSTRACT

A front portion of a terminal is provided with a flattened-rectangular tube-shaped box part for receiving a male tab terminal so as to establish contact and conduction thereto. Then, lock holes are provided at three parts of the center in the width direction of the box part and vicinities of both ends in the width direction. A lance for locking the terminal is formed in the shape of one plate. Three beaks protrude therefrom for engaging with the lock holes of the terminal. Further, the lance is provided with slits for improving elasticity and a linkage part for linking the three beaks together.

5 Claims, 17 Drawing Sheets

(56) References Cited

U.S. PATENT DOCUMENTS

| | | | | |
|---|---|---|---|---|
| 6,824,428 | B2 * | 11/2004 | Tabata et al. | 439/595 |
| 6,851,977 | B2 * | 2/2005 | Tsuji | 439/595 |
| 6,935,887 | B2 * | 8/2005 | Endo | 439/489 |
| 6,939,171 | B2 * | 9/2005 | Fukatsu et al. | 439/595 |
| 6,948,978 | B2 * | 9/2005 | Itou et al. | 439/595 |
| 6,951,484 | B2 * | 10/2005 | Tsuji | 439/595 |
| 7,001,214 | B2 | 2/2006 | Fuji | |
| 7,867,029 | B2 * | 1/2011 | Takahashi et al. | 439/595 |
| 8,419,471 | B2 * | 4/2013 | Suzuki et al. | 439/595 |
| 8,678,866 | B2 * | 3/2014 | Hiraishi | 439/752 |
| 8,747,156 | B2 * | 6/2014 | Hirabayashi | 439/595 |
| 8,801,451 | B2 * | 8/2014 | Muro | 439/345 |
| 8,858,259 | B2 * | 10/2014 | Chikusa et al. | 439/595 |
| 9,017,111 | B2 * | 4/2015 | Zheng et al. | 439/744 |
| 2002/0002001 | A1 * | 1/2002 | Fukamachi | 439/587 |
| 2005/0196983 | A1 * | 9/2005 | Fujii | 439/74 |

FOREIGN PATENT DOCUMENTS

| | | | |
|---|---|---|---|
| JP | 2519179 | Y2 | 12/1996 |
| JP | 2002-25675 | A | 1/2002 |
| JP | 2005-149904 | A | 6/2005 |
| JP | 2005-251520 | A | 9/2005 |
| JP | 2012-84404 | A | 4/2012 |

OTHER PUBLICATIONS

Written Opinion dated Oct. 1, 2013 issued in International Application No. PCT/JP2013/070230 (PCT/ISA/237).

Communication dated Oct. 1, 2013 issued by the International Searching Authority in counterpart International Application No. PCT/JP2013/070230 (PCT/ISA/237 with cover pages).

Office Action dated Jan. 27, 2016 issued by the Japanese Patent Office in counterpart Japanese Patent Application No. 2012-165185.

Communication issued Mar. 21, 2016, issued by the Korean Intellectual Property Office in counterpart Korean Patent Application No. 10-2015-7002136.

Communication issued on Mar. 30, 2016 by The State Intellectual Property Office of PR China in related Application No. 201380039116.X.

* cited by examiner

CONNECTOR

CROSS REFERENCE TO RELATED APPLICATIONS

This application is a continuation of PCT application No. PCT/JP2013/070230, which was filed on Jul. 25, 2013 based on Japanese Patent Application (No. 2012-165185) filed on Jul. 25, 2012, the contents of which are incorporated herein by reference.

BACKGROUND OF THE INVENTION

1. Field of the Invention

The present invention relates to a connector in which deflection (also referred to as twist) in a transverse direction is suppressed in a terminal inserted into a terminal accommodation chamber of a connector housing so that the terminal can be accommodated and held in the connector housing in an appropriate attitude.

2. Description of the Related Art

A connector is well-known in which a lance having flexibility is provided in a terminal accommodation chamber in the inside of a connector housing and then beaks (lock protrusions) of the lance engage with lock holes of the terminal so that the terminal is held and fixed (for example, see JP-A-2012-84404).

FIG. 15 shows an example of a connector of this kind according to the conventional art known to the public.

A connector 101 includes: a connector housing 110; a terminal 150 attached to the tip of an electric wire W and then accommodated and held in the inside of the connector housing 110; a front holder 170 attached to the inside of the connector housing 110 from the frontward thereof; a lever 180 attached to the connector housing 110 and then rotated at the time of fitting between the connector 101 and a counterpart connector 102 (see FIG. 17A) so as to establish complete fit by using a small force by using the principle of the lever; a waterproof plug 160; and a packing 165.

The connector housing 110 is provided with: an outer housing part 111; and an inner housing part 112 located on the inner side thereof. The inside of the inner housing part 112 is provided with a terminal accommodation chamber 114 into which the terminal 150 is inserted from the rearward thereof; a stopper 115 for positioning and locking the terminal 150 such as to prevent frontward movement thereof; and a flexible lance 120 for, when the terminal 150 is inserted into the terminal accommodation chamber 114 from the rearward thereof, pushed by the terminal 150 so as to temporarily suffer deformation to the outer side (downward in FIG. 15) of the insertion path for the terminal 150, then, at a stage that the terminal 150 has been inserted to a position determined by the stopper 115, restored from the deformation so that a beak 122 engages with a lock hole 154 of the terminal 150, and thereby positioning and locking the terminal 150 such as to prevent rearward movement thereof. The lance 120 is provided with only one beak 122.

Meanwhile, in the above-mentioned connector 101 of the conventional art, as shown in FIG. 16, when a tension in a bending direction (in a transverse direction perpendicular to the frontward and rearward directions identical to the insertion direction of the terminal) indicated by arrow X acts on the electric wire W extending to the rearward of the connector housing 110, a possibility arises that the terminal deflects excessively in the transverse direction in the inside of the terminal accommodation chamber.

In particular, in the connector 101 of the conventional art, as shown in FIG. 17A, merely one beak 122 provided in the lance 120 engages with the lock hole 154 of the terminal 150. Thus, a possibility arises that a force (i.e., a holding force) for holding the terminal 150 in the inside of the terminal accommodation chamber 114 is weak. Further, a possibility arises that backlash in the inside of the terminal accommodation chamber 114 allows the terminal 150 to easily deflect obliquely in a transverse direction, and hence a possibility arises that the terminal 150 is twisted in a transverse direction so that engagement between the terminal 150 and the lance 120 is easily released.

Further, when the connector 101 and the counterpart connector 102 fit to each other in a state that a tension acts on the electric wire W, like in a portion indicated by P in FIG. 17B, a possibility arises that the tip of the male tab terminal 106 of the counterpart connector 102 violently collides with the front end of the terminal 150 of the connector 101, and hence a possibility arises that poor contact occurs in a worst case.

The present invention has been devised in view of the above-mentioned situation. An object thereof is to provide a connector in which even in a case that a twisting force in the right and left directions acts on a terminal when an electric wire extending to the rearward of a connector housing is pulled or the like in a transverse direction, deflection (also referred to as twist) of the terminal in the inside of a terminal accommodation chamber can be suppressed to a minimal extent so that the problem of violent collision of the terminals at the time of connector fitting is resolved so that the terminals can smoothly be electrically connected to each other and further a holding force for the terminal can be improved.

SUMMARY

The present invention is characterized by a connector having the configuration of the following (1) to (5).

(1) There is provided a connector including a connector housing and a terminal attached to a tip of an electric wire and accommodated and held in the inside of the connector housing, wherein the connector housing includes: a terminal accommodation chamber into which the terminal is inserted from a rearward of the terminal accommodation chamber; a stopper configured to, when a front portion of the terminal is inserted into the terminal accommodation chamber from the rearward thereof, abut against the front portion of the terminal, and position and lock the terminal so as to prevent frontward movement of the terminal; and a flexible lance configured to, when the terminal is inserted into the terminal accommodation chamber from the rearward thereof, be pushed by the terminal so as to be temporarily deformed to the outer side of an insertion path for the terminal, then, at a stage that the terminal has been inserted to a position determined by the stopper, and be restored from the deformation state so that beaks engage with lock holes of the terminal, thereby positioning and locking the terminal so as to prevent rearward movement of the terminal, wherein a front portion of the terminal is provided with a flattened-rectangular tube-shaped box part configured to, when a male tab terminal of a counterpart connector has entered from a frontward of the connector housing, receive and then go into contact with the male tab terminal; and wherein the lock holes are provided respectively at three parts of a center in a width direction and vicinities of both ends in the width direction of wide-width peripheral walls constituting the box part; wherein the three beaks, engaging respectively with the lock holes at the three parts of the terminal, protrude from the lance.

(2) The connector of the above-mentioned (1), wherein: the lance is formed in a shape of one plate having a wide width corresponding to a width dimension of the box part of the terminal; the three beaks, engaging respectively with the lock holes at the three parts of the terminal, protrude from a wide-width surface of the plate-shaped lance; in the lance, slits for improving elasticity of the lance are formed along frontward and rearward directions of the lance so as to be located between the beaks arranged at both ends in the width direction of the lance and the beak arranged in the center in the width direction; and tips of three portions separated in the width direction of the lance by the slits are linked together by the linkage part.

(3) The connector of the above-mentioned (1) or (2), the beaks are constructed such that the positions of the beaks arranged at both ends in the width direction of the lance and the position of the beak arranged in the center in the width direction deviate from each other in the frontward and rearward directions of the lance; front ends of the three beaks engage with front hole edges of the individual lock holes; and at least side surfaces of the beaks arranged at both ends in the width direction engage with side hole edges of the lock holes.

(4) The connector of the above-mentioned (3), wherein the beaks arranged at both ends in the width direction are formed longer in the frontward and rearward directions of the lance than the beak arranged in the center in the width direction.

(5) The connector of any one of the above-mentioned (1) to (4), including: a front holder configured to be attached to the inside of the connector housing from the frontward thereof, wherein the front holder is configured to be pushed into the connector housing from a temporary lock position on a near side in a mounting direction of the front holder to a completely lock position on a far side in the mounting direction of the front holder;

wherein the lance is provided in the connector housing such as to prevent a situation that the terminal inserted from the rearward of the connector housing drops out to the rearward thereof in a state that the front holder is located at the temporary lock position; and wherein the front holder is provided with a lance pressing part configured to, in a state that the terminal is locked by the lance, when the front holder is pushed in from the temporary lock position to the completely lock position, enter a deformation space of the lance so as to inhibit deformation of the lance and thereby double-lock the terminal.

According to the connector having the configuration of the above-mentioned (1), the three beaks arranged and aligned in the width direction of the lance prevent the terminal from dropping out to the rearward of the connector housing. Thus, even in a case that a force in the right and left directions acts on the terminal when the electric wire is pulled or the like in a transverse direction, deflection (also referred to as twist) of the terminal in the inside of the terminal accommodation chamber can be suppressed to a minimal extent. Thus, at the time that the connector and the counterpart connector are fit to each other, a situation is prevented that the male tab terminal of the counterpart connector violently collides with the terminal of the connector. Thus, the terminals can smoothly be electrically connected to each other. Further, since the three beaks hold the terminal, improvement is achievable in the holding force of the terminal.

According to the connector having the configuration of the above-mentioned (2), the lance is formed in a plate shape having a wide width because of the three beaks having been provided. This causes an increase in the rigidity of the lance and hence causes an increase in the insertion resistance at the time of terminal insertion. However, the slits are provided and make easy the elastic deformation of the lance. This can suppress the increase in the insertion resistance as much as possible. Further, the tips of the three portions separated in the width direction of the lance by the slits are linked together by the linkage part. Thus, in a case that the lance is forcedly warped for the purpose of removing the terminal, when the center beak is merely displaced in the engagement separating direction, the other beaks also can be displaced together in the engagement separating direction. Thus, at the time of terminal removal, it is sufficient to perform the same operation as the conventional case of one beak.

According to the connector having the configuration of the above-mentioned (3), the front ends of the three beaks engage with front hole edges of the individual lock holes so that the terminal is prevented from moving to the rearward of the connector housing and hence is positioned and held reliably. Further, side end surfaces of the two beaks arranged at both ends in the width direction of the lance engage with side hole edges of the lock holes so that the terminal is restricted such as not to move in the width direction. Furthermore, a setup is employed that the three beaks are not aligned in line in the width direction of the lance. This can effectively prevent twist of the terminal.

According to the connector having the configuration of the above-mentioned (4), the beaks arranged at both ends in the width direction of the lance are formed longer in the frontward and rearward directions of the lance than the beak arranged in the center in the width direction. Thus, the terminal can be supported by the side surfaces of the longer beaks and hence the effect of side surfaces support for the terminal can be increased so that the twist can be prevented reliably. That is, the holding attitude for the terminal can be maintained appropriate and hence the male tab terminal of the counterpart connector can reliably be prevented from violently colliding with the front end of the terminal of the connector.

According to the connector having the configuration of the above-mentioned (5), in a state that the terminal is inserted into the terminal accommodation chamber and then locked by the lance, when the front holder is pushed in from the temporary lock position to the completely lock position, the terminal can be double-locked so that the terminal can reliably be stopped from dropping out.

According to the present invention, the three beaks arranged and aligned in the width direction of the lance lock the terminal such as not to drop out to the rearward of the connector housing. Thus, even in a case that a twisting force in the right and left directions acts on the terminal when the electric wire is pulled or the like in a transverse direction, deflection (also referred to as twist) of the terminal in the inside of the terminal accommodation chamber can be suppressed to a minimal extent. Thus, at the time that the connector and the counterpart connector are fit to each other, a situation is prevented that the male tab terminal of the counterpart connector violently collides with the terminal of the connector. Thus, the terminals can smoothly be electrically connected to each other. Further, since the three beaks hold the terminal, improvement is achievable in the holding force of the terminal.

Brief description of the present invention has been given above. Details of the present invention will be clarified further when Best Mode for Carrying Out the Invention (referred to as an "embodiment", hereinafter) given below is read thoroughly with reference to the accompanying drawings.

BRIEF DESCRIPTION OF THE DRAWINGS

FIG. 7A is a perspective view; FIG. 7B is a plan view; FIG. 7C is a front view; and FIG. 7D is a side view.

FIG. 8A is a sectional side view showing a situation prior to the front holder being pushed in from the temporary lock position to the completely lock position; and FIG. 8B is a sectional side view showing a situation that the front holder has been pushed in from the temporary lock position to the completely lock position.

FIG. 9A is a sectional side view showing a situation prior to the front holder being pulled out from the completely lock position to the temporary lock position; and FIG. 9B is a sectional side view showing a situation that the front holder has been pulled out from the completely lock position to the temporary lock position.

FIG. 10A is a sectional side view showing a situation that a lock release fixture is inserted into the terminal accommodation chamber so that the lance is forced to warp to a lock release side; and FIG. 10B is a sectional side view showing a situation that in this state, the terminal is extracted from the terminal accommodation chamber.

FIG. 13A is an overall horizontal sectional view; and FIG. 13B is an enlarged view showing, in a state that a part thereof is enlarged, a situation that electrical connection can be established without causing violent collision between a male tab terminal of the counterpart connector and a terminal of the connector of interest.

FIG. 17A is an overall horizontal sectional view; and FIG. 17B is an enlarged view showing, in a state that a part thereof is enlarged, a situation that violent collision is caused between a male tab terminal of a counterpart connector and a terminal of a connector of interest.

DETAILED DESCRIPTION OF THE EXEMPLARY EMBODIMENTS

An embodiment of the present invention is described below with reference to the drawings.

FIGS. 1 to 14 show a connector of an embodiment.

Figure 1:
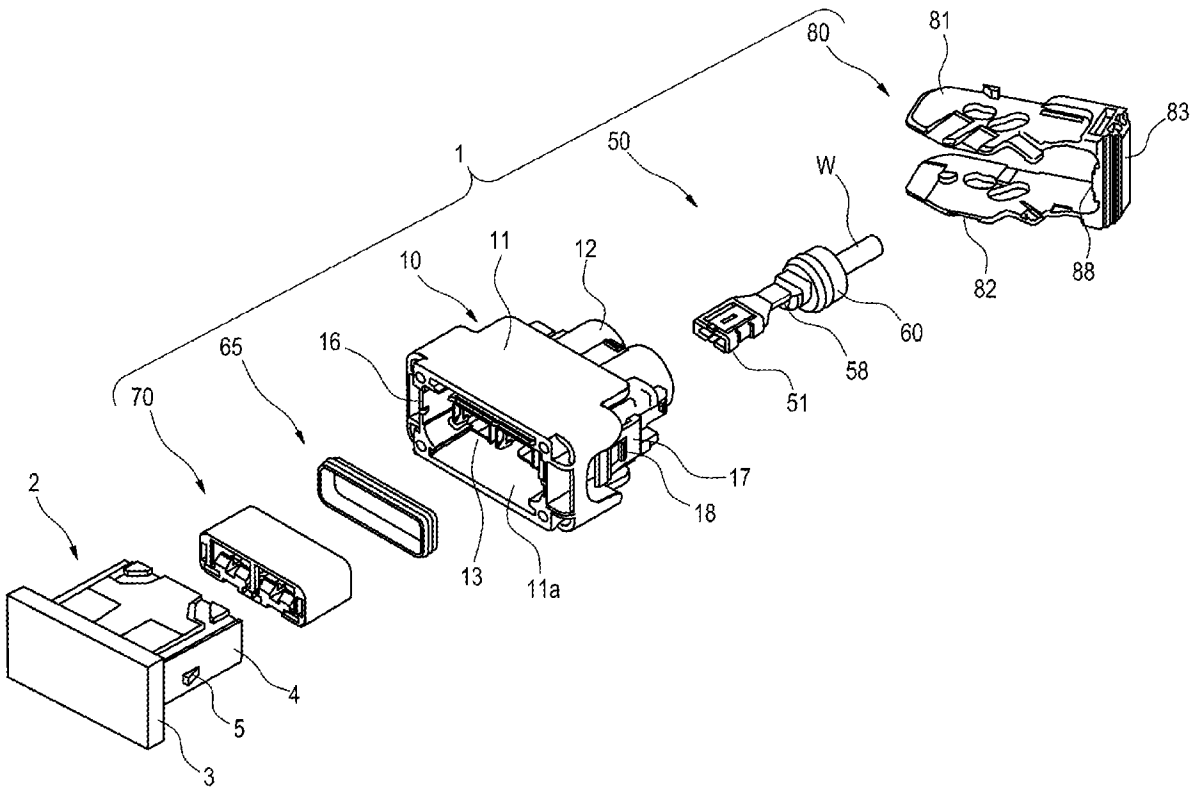
FIG. 1 is an exploded perspective view of a connector of an embodiment of the present invention.
Figure 2:
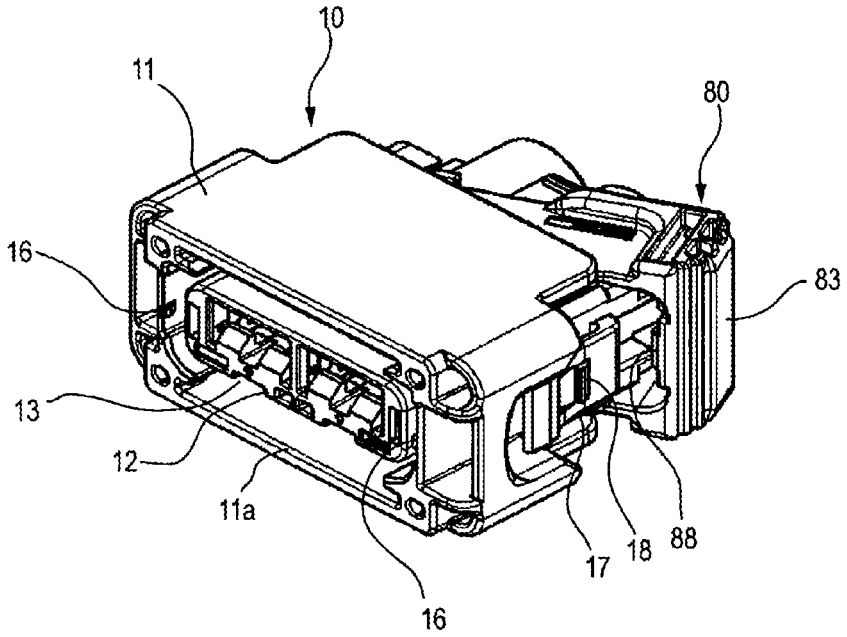
FIG. 2 is an external appearance perspective view showing a situation prior to the connector being fit to a counterpart connector.

The connector 1 is a female connector fit to a counterpart male connector 2 and, as shown in FIGS. 1 and 2, includes: a connector housing 10 fabricated from resin; a necessary number of metal-fabricated terminals 50 each attached to the tip of an electric wire W and then accommodated and held in the inside of the connector housing 10; a front holder 70 fabricated from resin and attached to the inside of the connector housing 10 from the frontward thereof; a lever 80 attached to the connector housing 10 in a rotatable manner and, at the time of fitting between the connector 1 and the counterpart connector 2, after both connectors 1 and 2 are brought into an initial fitting state, when rotated from a temporary lock position to a completely lock position, establishing complete fit between the connector 1 and the counterpart connector 2 by using a small force by using the principle of the lever; a waterproof plug 60; and a packing 65.

The connector housing 10 is provided with: an outer housing part 11 having an aperture 11*a* located in the front face; and an inner housing part 12 located on the inner side thereof. Between the outer housing part 11 and the inner housing part 12, a hood part fitting space 13 is ensured where a hood part 4 of the counterpart connector 2 enters at the time of fitting between the connector 1 and the counterpart connector 2. Here, the outer housing part 11 and the inner housing part 12 are linked to each other in an integrated manner at a position not causing disturbance to components attached later.

Figure 3:
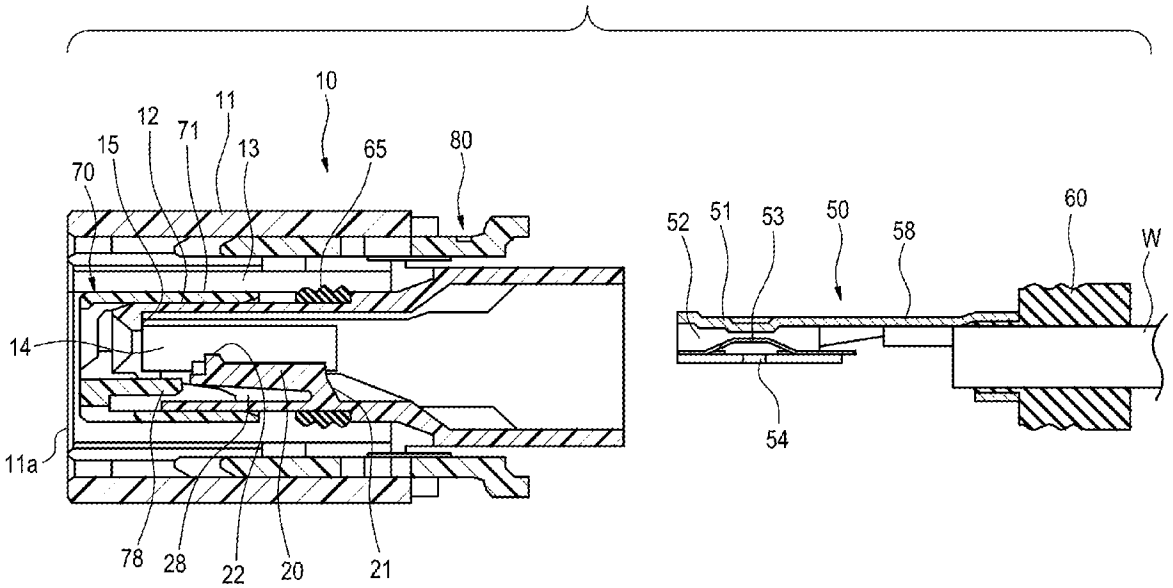
FIG. 3 is an explanation diagram for the connector, which is a sectional side view showing a situation that a terminal attached to the tip of an electric wire is to be inserted into a terminal accommodation chamber of a connector housing.
Figure 5A:
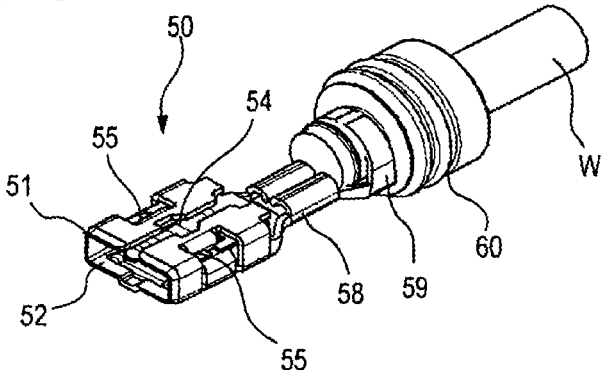
FIG. 5A is a perspective view showing a configuration on the lower surface side of the terminal.
Figure 5B:
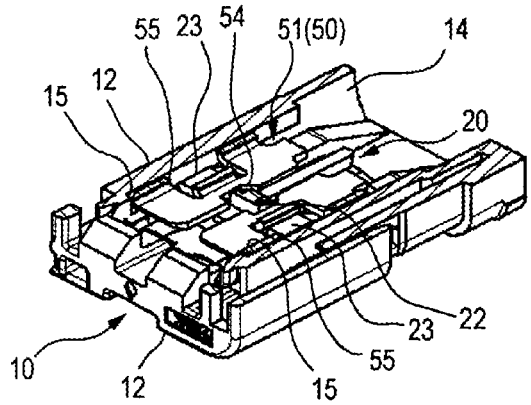
FIG. 5B is a perspective view showing in a horizontal cross section an engagement state in a situation that the terminal has been inserted into a terminal accommodation chamber.
Figure 5C:
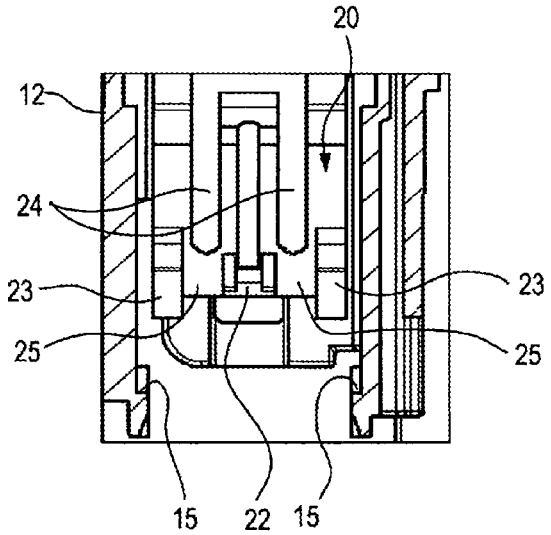
FIG. 5C is a plan view showing in a horizontal cross section a configuration on the terminal accommodation chamber side.
Figure 6:
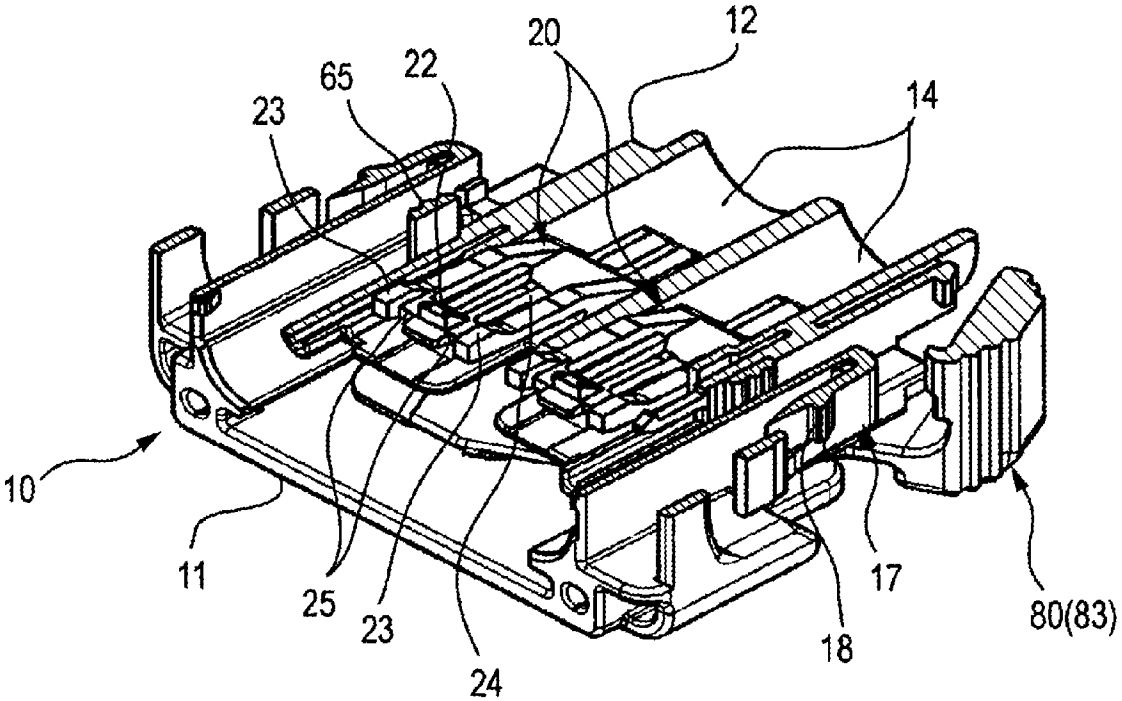
FIG. 6 is a perspective view showing in a horizontal cross section a configuration of a lance provided in the terminal accommodation chamber.
Figure 7A:
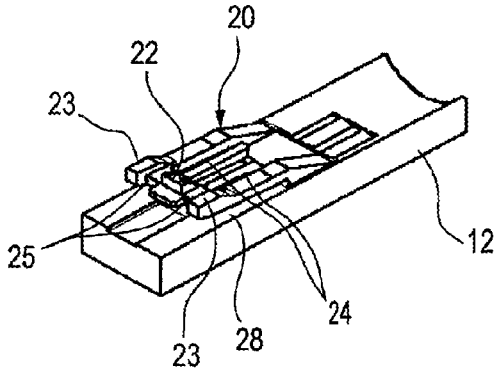
FIGS. 7A to 7D are configuration diagrams for a lance.
Figure 7B:
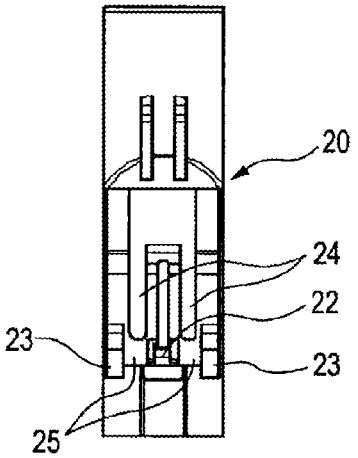
Figure 7C:
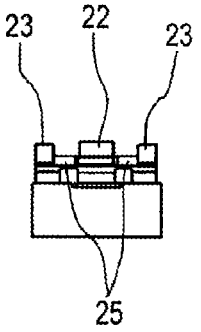
Figure 7D:
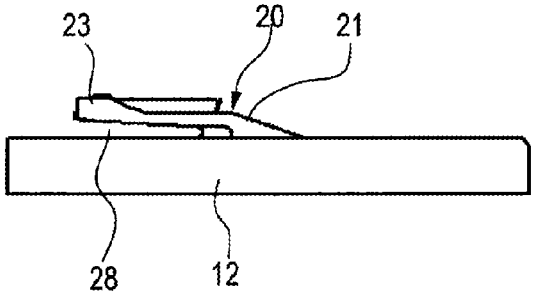

The inside of the inner housing part 12 is provided with: a plurality of terminal accommodation chambers 14 into each of which the terminal 50 is inserted from the rearward of the inner housing part 12 as shown in FIG. 3; a stopper 15 for, when the front portion of the terminal 50 inserted from the rearward thereof abuts against the terminal accommodation chamber 14, positioning and locking the terminal 50 relative to the frontward as shown in FIGS. 5B and 5C; and a flexible lance 20, when the terminal 50 has been inserted into the terminal accommodation chamber 14 from the rearward thereof, pushed by the terminal 50 so as to temporarily suffer deformation to the outer side (downward in FIG. 3) of the insertion path for the terminal 50, then, at a stage that the terminal 50 has been inserted to a position determined by the stopper 15, restored from the warped state so that beaks 22 and 23 engage with lock holes 54 and 55 of the terminal 50, and thereby positioning and locking the terminal 50 such as to prevent rearward movement thereof.

As shown in FIGS. 3 and 5A, the front portion of the terminal 50 is provided with a flattened-rectangular tube-shaped box part 51 for, when a male tab terminal of the counterpart connector 2 has entered from the frontward of the connector housing 10, receiving the male tab terminal so as to be electrically connected to the male tab terminal. The rear part of the terminal 50 is provided with an electric wire swage part 58 swaged and fixed to the tip of the electric wire W. The terminal 50 includes lock holes 54 and 55 provided respectively at three sites consisting of the center in the width direction and the vicinities of both ends in the width direction of the wide-width peripheral walls constituting the box part 51. The inside of the box part 51 is provided with: a plug-in space 52 into which the male tab terminal is received; and a spring piece 53 for pinching the male tab terminal having entered the plug-in space 52, in cooperation with the peripheral wall of the box part 51.

The outer periphery of the electric wire W whose tip is fixed to the terminal 50 is provided with the rubber-fabricated waterproof plug 60 for sealing a gap between the peripheral wall of the terminal accommodation chamber 14 and the outer periphery of the electric wire W. The outer periphery of the inner housing part 12 of the connector housing 10 is provided with the packing 65 for, when the connector 1 and the counterpart connector 2 are fit to each other, sealing a gap between the hood part 4 of the counterpart connector 2 and the inner housing part 12. The connector 1 is constructed in waterproof by means of sealing operation of the waterproof plug 60 and the packing 65. Here, as shown in FIG. 5A, the waterproof plug 60 swaged and fixed on the insulation cover of the electric wire W by using a swage piece 59 provided at the rear end of the terminal 50.

The rear end 21 of the lance 20 is fixed to the inner peripheral wall of the inner housing part 12 so that the lance 20 is provided in a cantilever manner in an orientation that the tip of free end is directed frontward. As shown in FIGS. 5B, 5C, 6, 7A and 7B, the lance 20 is formed in the shape of one plate having a wide width corresponding to the width dimension of the box part 51 of the terminal 50. Then, three beaks 22 and 23 engaging respectively with the three lock holes 54 and 55 of the terminal 50 protrude from the wide-width surface near the tip of free end of the plate-shaped lance 20.

In this case, in the lance 20, slits 24 for improving the elasticity of the lance 20 are formed between the beaks 23 arranged at both ends in the width direction of the lance 20 and the beak 22 arranged in the center in the width direction along the frontward and rearward directions of the lance 20. The tips of the three portions separated in the width direction of the lance 20 by the slits 24 are linked together by the linkage part 25. Further, the construction is such that: the positions of the beaks 23 arranged at both ends in the width direction of the lance 20 and the position of the beak 22 arranged in the center in the width direction deviate from each other in the frontward and rearward directions of the lance 20; the front ends of the three beaks 22 and 23 engage with the front hole edges of the individual lock holes 54 and 55; and the side surfaces of at least the beaks 23 arranged at both ends in the width direction engage with the side hole edges of the lock holes 55. Further, the beaks 23 arranged at both ends in the width direction are formed longer in the frontward and rearward directions of the lance 20 than the beak 22 arranged in the center in the width direction.

The front holder 70 is capable of being pushed into the inner housing part 12 of the connector housing 10 from the temporary lock position on the near side of the inner housing part 12 to the completely lock position on the far side of the inner housing part 12. Here, means of holding the front holder 70 at the completely lock position is not specifically shown in the figure.

When the front holder 70 is located at the temporary lock position, the lance 20 is pushed by the terminal 50 inserted from the rearward of the connector housing 10 and thereby temporarily suffers deformation to a deformation space 28 side. Then, at a stage that the terminal 50 has been inserted to the position of being stopped by the stopper 15, the lance 20 is restored from the warped state and thereby can position and lock the terminal 50 such as to prevent rearward movement thereof.

Figure 10A:
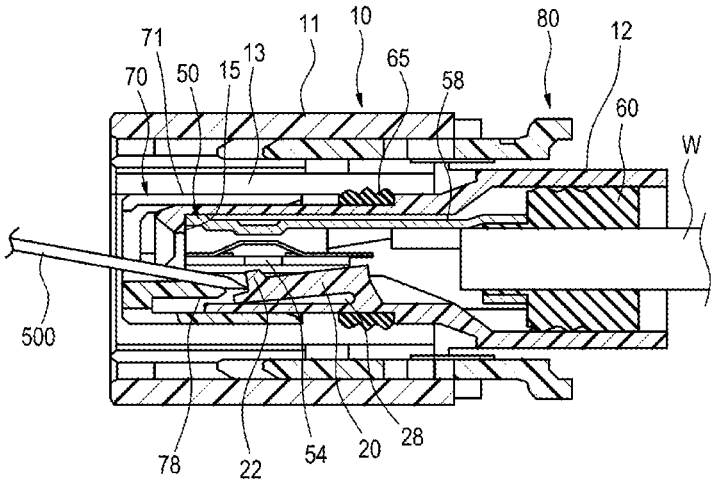
FIGS. 10A and 10B are operation explanation diagrams for a situation that in a state that the front holder has been pulled out to the temporary lock position as shown in FIG. 9B, the terminal is extracted.
Figure 10B:
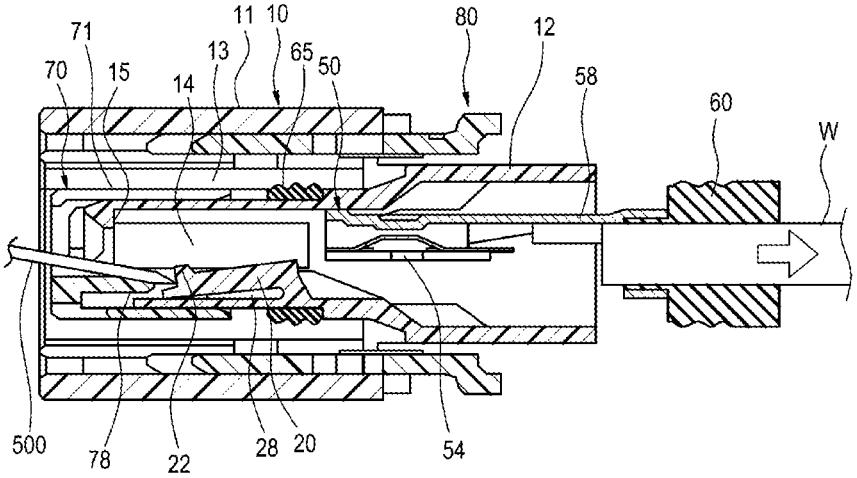

The front holder 70 is provided with a tubular wall 71 fit to the front end outer peripheral part of the inner housing part 12. The bottom side of the tubular wall 71 is provided with a lance pressing part 78 for, in a state that the terminal 50 is locked and drop-out-prevented by the lance 20, when the front holder 70 is pushed in from the temporary lock position to the completely lock position as shown in FIG. 8B, entering the deformation space 28 for the lance 20 so as to inhibit deformation of the lance 20 and thereby double-lock the terminal 50. Here, the front holder 70 is formed in the shape of penetrating in the frontward and rearward directions. Then, as shown in FIGS. 10A and 10B, when a lock release fixture 500 is inserted from the frontward of the front holder 70, the lance 20 can forcedly be warped to the lock release side.

As shown in FIG. 1, the lever 80 is constructed from: a pair of side plates 81 and 82 opposite in parallel to each other; and a connection operation part 83 for linking the pair of side plates 81 and 82 so as to form a square-bracket shape in front view. The lever 80 is attached to the connector housing 10 in a horizontally rotatable manner in a state that both side plates 81 and 82 are arranged at positions of pinching the inner housing part 12 of the connector housing 10 from up and down. The lever 80 is constructed such as to, when rotated from the temporary lock position, establish complete fit between the connector 1 and the counterpart connector 2 having been brought into initial fitting.

Here, as shown in FIG. 1, the connection operation part 83 of the lever 80 is provided with an engagement pawl 88 for, when the lever 80 is rotated to the completely lock position, engaging with a lock part 18 provided in the lock arm 17 on the connector housing 10 side. Further, a housing 3 of the counterpart connector 2 and the inner periphery of the outer housing part 11 of the connector 1 are provided with temporary lock projections 16 and 5 for engaging with each other so as to hold a temporary engagement state.

Next, an assembly procedure and a decomposition procedure are described below.

Figure 4A:
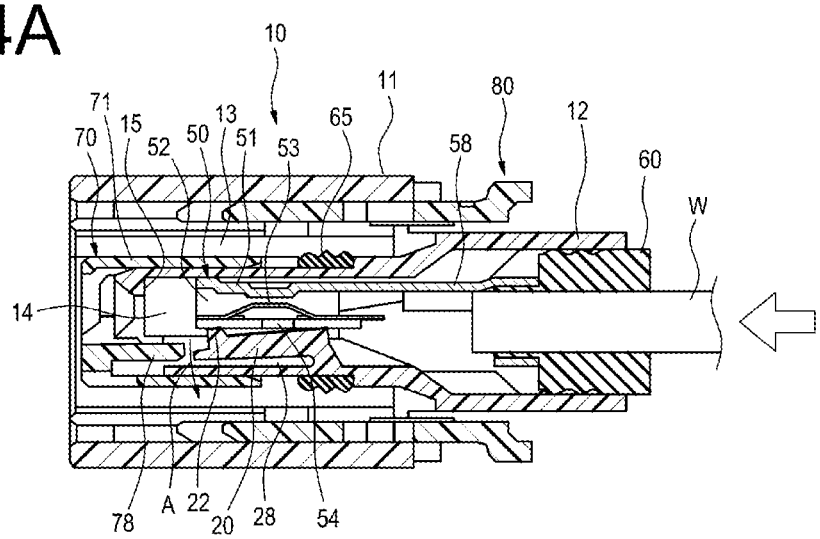
FIG. 4A is a sectional side view showing a situation that a terminal attached to the tip of an electric wire is under insertion into a terminal accommodation chamber of the connector housing.
Figure 4B:
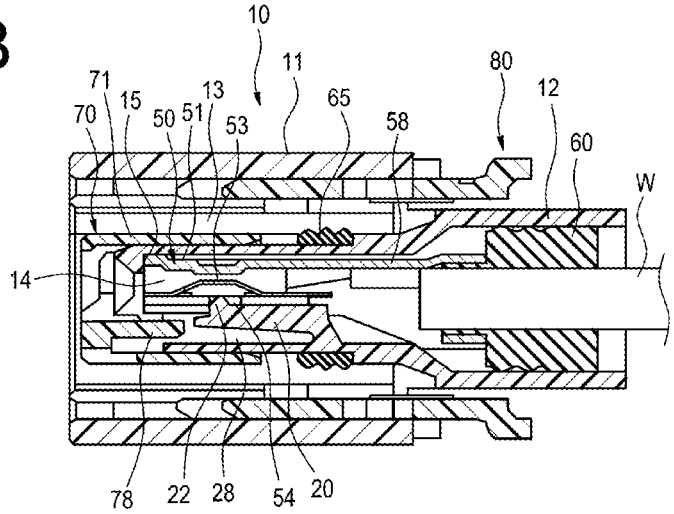
FIG. 4B is a sectional side view showing a situation that the terminal attached to the tip of the electric wire has been inserted into the terminal accommodation chamber of the connector housing.

The front holder 70, the lever 80, and the packing 65 are assembled to the connector housing 10 in advance. Further, the front holder 70 and the lever 80 are held at the temporary lock position. In this state, when the terminal 50 attached to the tip of the electric wire W is to be assembled to the connector housing 10, as shown in FIGS. 3, 4A and 4B, the terminal 50 is inserted into the terminal accommodation chamber 14 from the rearward thereof. When the terminal 50 has been inserted, the waterproof plug 60 attached to the outer periphery of the electric wire W goes into close contact with the peripheral wall inner surface of the terminal accommodation chamber 14 so that the gap between the peripheral wall of the terminal accommodation chamber 14 and the outer periphery of the electric wire W is sealed.

Further, when the terminal 50 is inserted, as shown in FIG. 4A, the lance 20 is pushed by the terminal 50 so as to temporarily warp from the insertion path for the terminal 50 to the outer side in the arrow A direction. At this stage, the front holder 70 is located at the temporary lock position and hence the deformation space 28 for the lance 20 is ensured on the outer side of the lance 20. As shown in FIGS. 4B and 5B, the front portion of the terminal 50 having been inserted abuts against the stopper 15 provided at the front end of the terminal accommodation chamber 14 so that the terminal 50 is stopped. At the same time, the lance 20 is restored from the warped state to the original position so that the three beaks 22 and 23 of the lance 20 engage respectively with the lock holes 54 and 55 of the terminal 50. By virtue of this, the terminal 50 is held in a locked state.

Figure 8A:
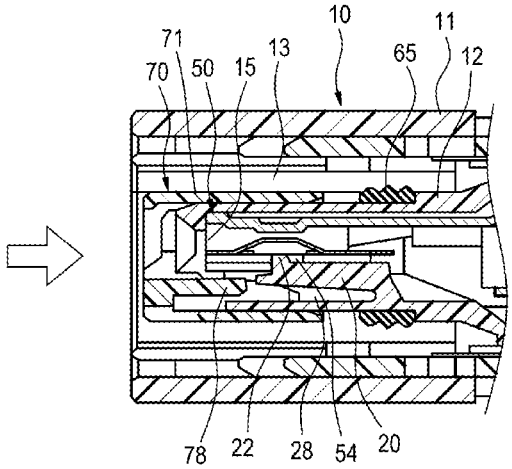
FIGS. 8A and 8B are operation explanation diagrams for the operation that after a terminal is inserted as shown in FIG. 4B, a front holder is pushed in from a temporary lock position to a completely lock position.
Figure 8B:
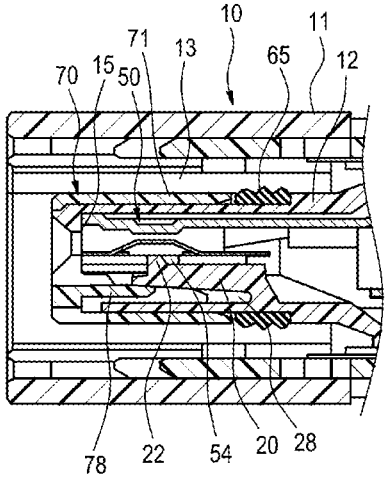

Then, the front holder 70 in the temporary locking state shown in FIG. 8A is pushed in as shown in FIG. 8B so that the front holder 70 goes into a proper locked state. At the same time, the lance pressing part 78 of the front holder 70 enter the deformation space 28 for the lance 20 so as to holds the lance 20 in a deformation-inhibited state. By virtue of this, the terminal 50 is fixed by double lock.

Figure 9A:
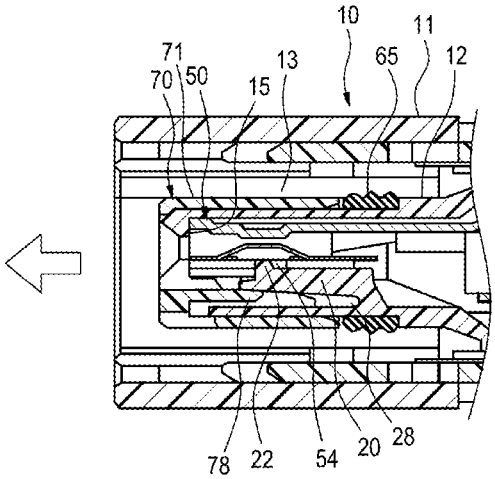
FIGS. 9A and 9B are operation explanation diagrams for a situation that on the contrary to the case of FIGS. 8A and 8B, the front holder is pulled out from the completely lock position to the temporary lock position for the purpose of removing the inserted terminal.
Figure 9B:
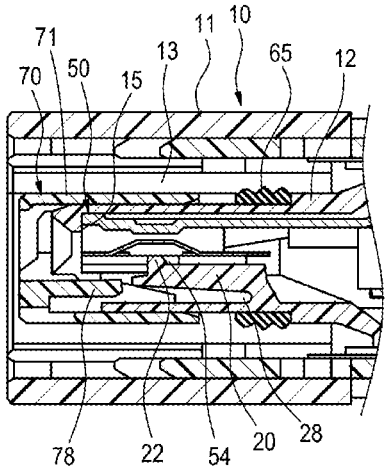

When the terminal 50 is to be removed from this state, as shown in FIGS. 9A and 9B, the front holder 70 is first pulled back from the completely lock position to the temporary lock position so that the lance 20 is brought into a deformation-permitted state. Then, as shown in FIGS. 10A and 10B, the lock release fixture 500 is inserted from the frontward of the front holder 70 so that the lance 20 is forcedly warped to the outer side by the tip of the lock release fixture 500. As a result, the beaks 22 and 23 of the lance 20 depart respectively from the lock holes 54 and 55 of the terminal 50. Thus, in this state, when the terminal 50 is pulled to the rearward thereof, the terminal 50 can be removed from the terminal accommodation chamber 14.

Figure 11:
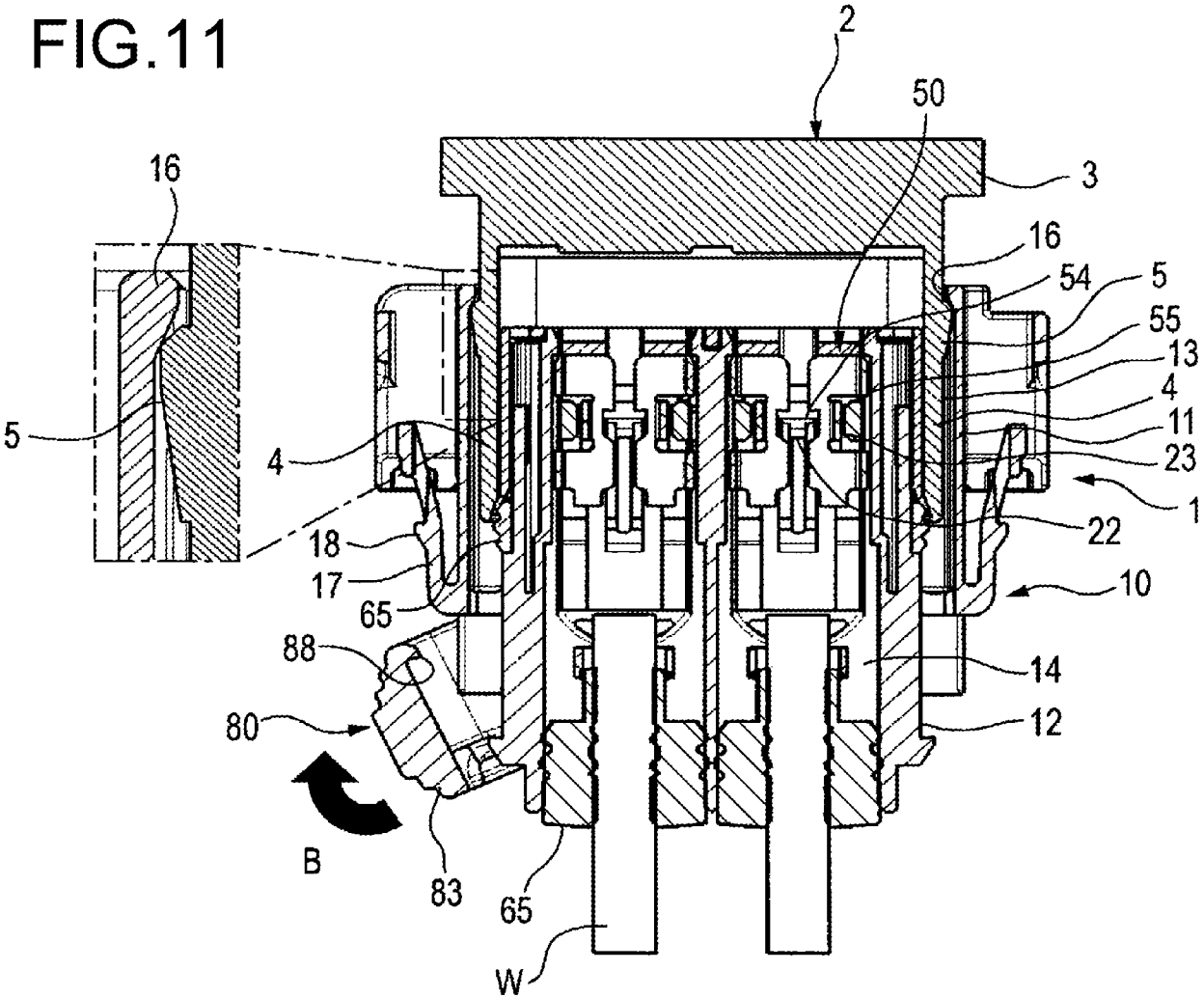
FIG. 11 is a procedure explanation diagram for a situation that a connector of an embodiment and a counterpart connector are fit to each other, which is a horizontal sectional view showing a situation that the connector of interest and the counterpart connector have been brought into initial fitting to each other and then, in this state, a lever is to be rotated.

Further, in the state shown in FIG. 8B, when the connector 1 and the counterpart connector 2 are to be fit to each other, as shown in FIG. 11, the housing 3 of the counterpart connector 2 and the outer housing part 11 of the connector housing 10 are brought into initial fitting so that the temporary lock projections 16 and 5 engage with each other.

Figure 12:
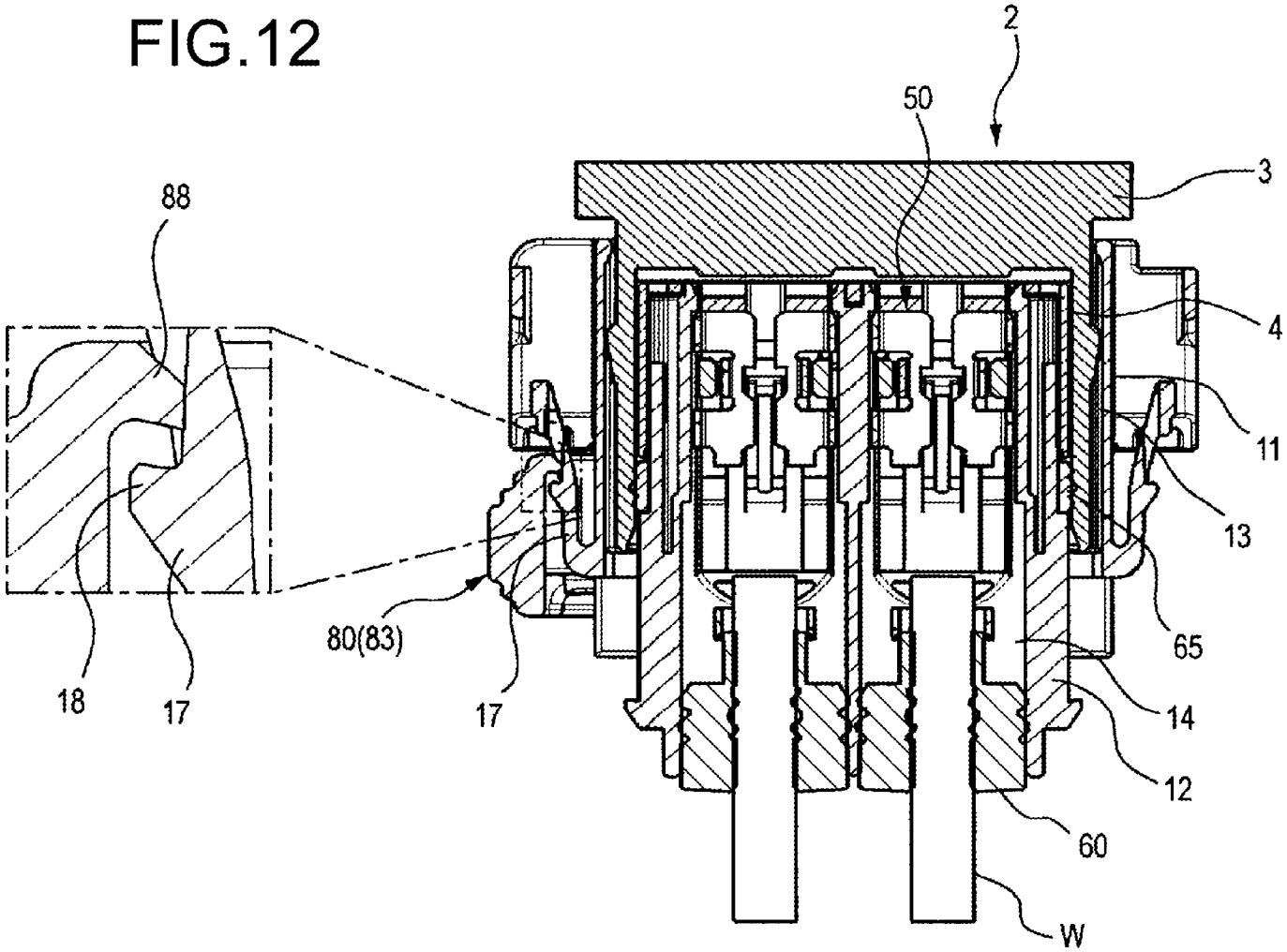
FIG. 12 is a horizontal sectional view and an enlarged view of a part thereof showing a situation that the lever has been rotated so that both connectors have been completely fit to each other.
Figure 14:
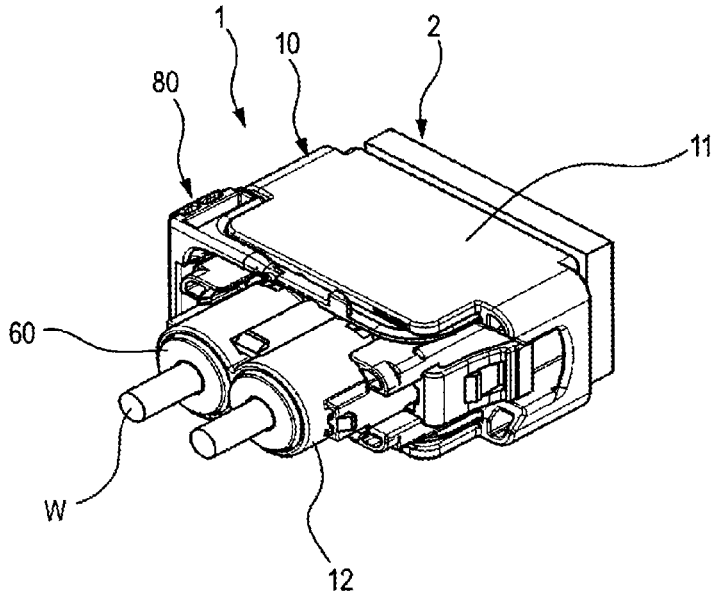
FIG. 14 is an external appearance perspective view showing a situation that a connector of an embodiment is brought into the state of FIG. 12.
Figure 15:
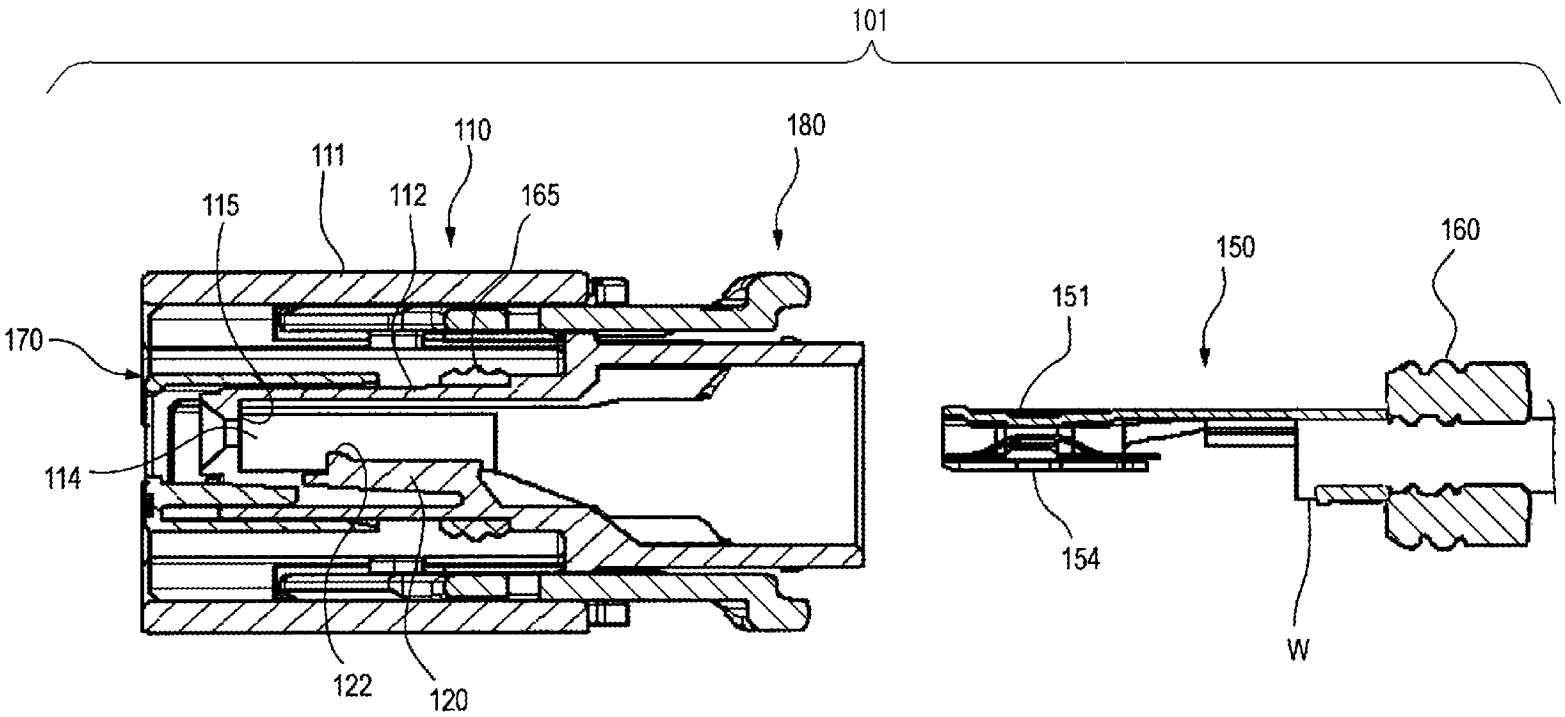
FIG. 15 is an explanation diagram for a connector of the conventional art, which is a sectional side view showing a situation that a terminal attached to the tip of an electric wire is to be inserted into a terminal accommodation chamber of a connector housing.
Figure 16:
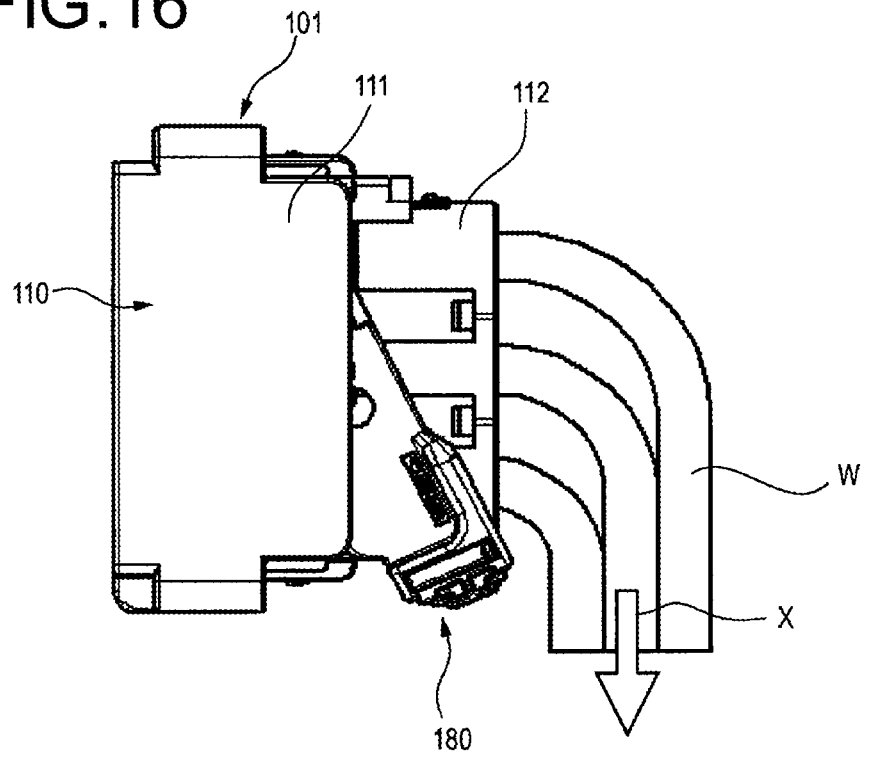
FIG. 16 is a plan view showing a situation that before a connector of a conventional example is fit to a counterpart connector, a pulling force in a transverse direction acts on the electric wire.
Figure 17A:
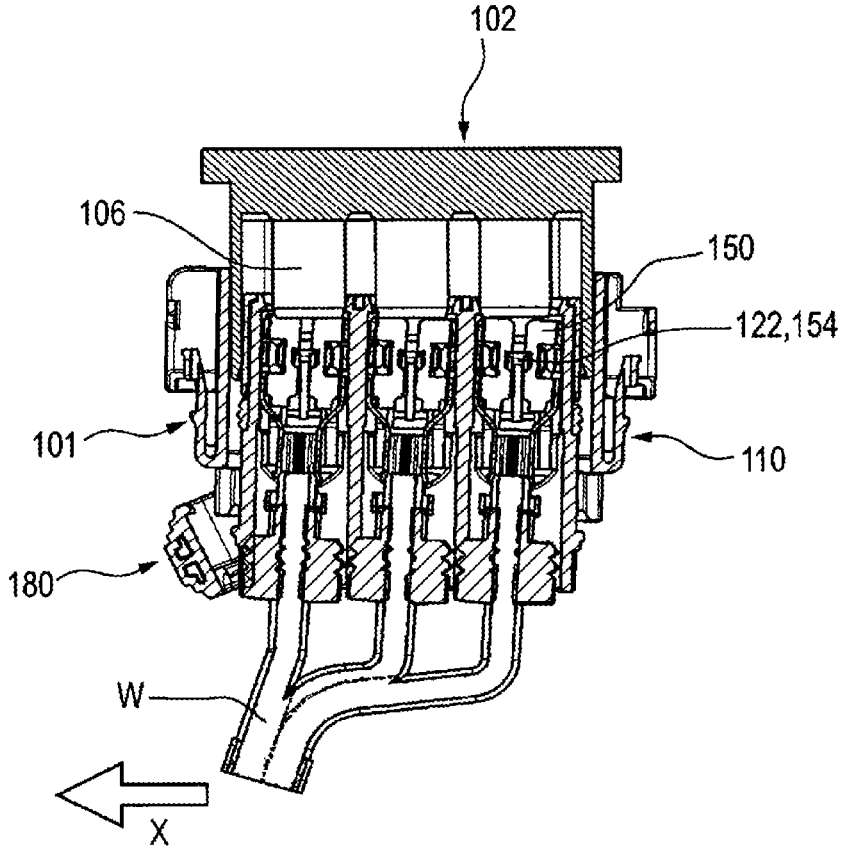
FIGS. 17A and 17B are diagrams showing a situation that a pulling force in a transverse direction has acted on an electric wire as shown in FIG. 16 so that a terminal has excessively deflected in a transverse direction in the inside of a terminal accommodation chamber.
Figure 17B:
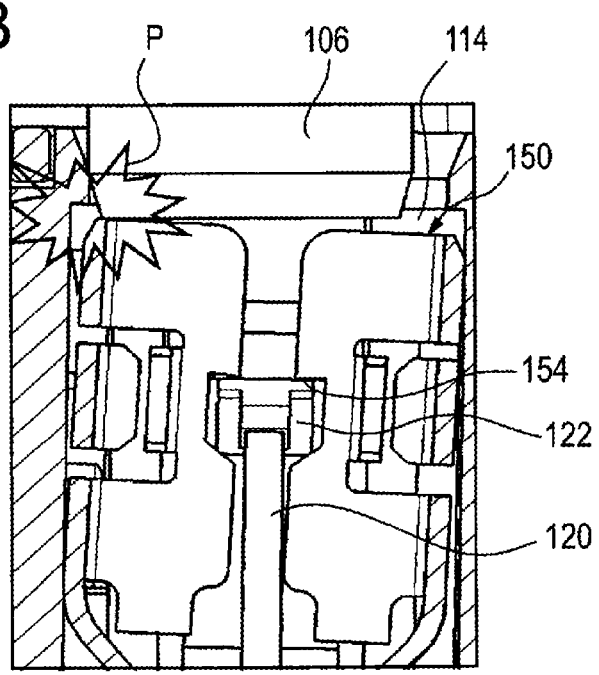

Then, the lever 80 is revolved in the arrow B direction. Then, by virtue of the rotation of the lever 80, the connector 1 and the counterpart connector 2 are completely fit to each other. Thus, the hood part 4 of the counterpart connector 2 is fit to the outer periphery of the packing 65 so that the gap between the hood part 4 of the counterpart connector 2 and the inner housing part 12 of the connector 1 is sealed. At the same time, as shown in FIGS. 12 and 14, the engagement pawl 88 provided in the lever 80 engages with the lock part 18 provided in the lock arm 17 on the connector housing 10 side so that the lever 80 is held at the completely lock position.

Figure 13A:
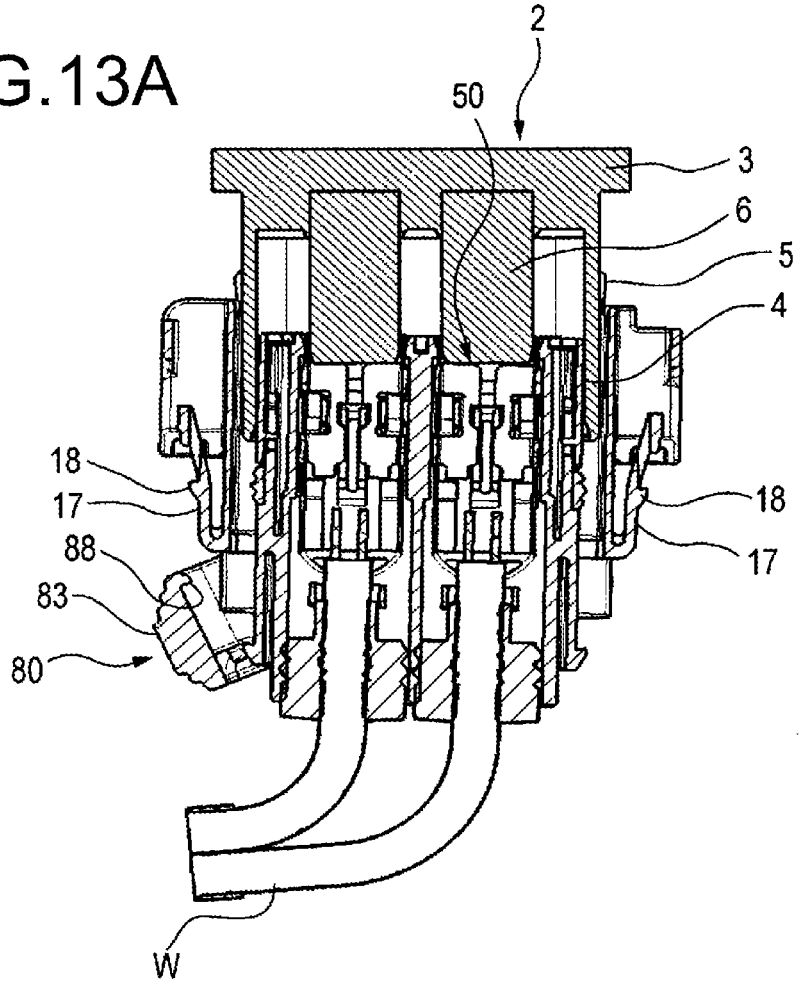
FIGS. 13A and 13B are diagrams showing a situation that before a connector of an embodiment is fit to a counterpart connector, a pulling force in a transverse direction acts on an electric wire.
Figure 13B:
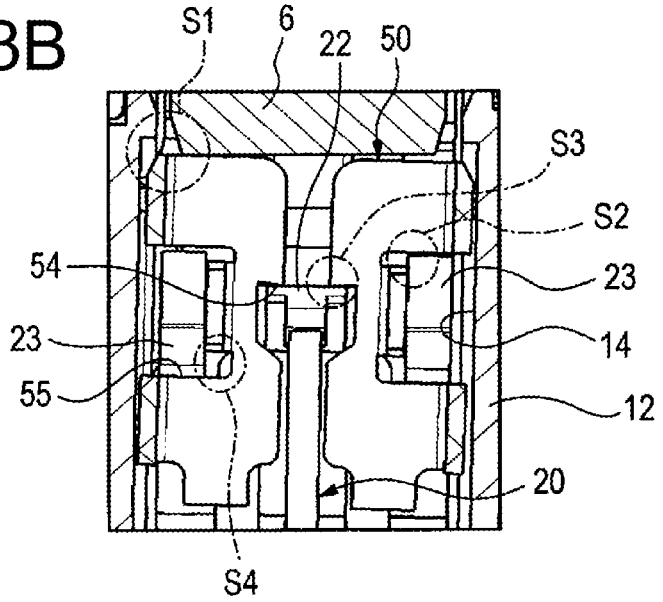

According to the connector 1 of the above-mentioned configuration, the three beaks 22 and 23 arranged and aligned in the width direction of the lance 20 prevent the terminal 50 from dropping out to the rearward of the connector housing 10. By virtue of this, as shown in FIGS. 13A and 13B, even in a case that a twisting force in the right and left directions acts on the terminal 50 when the electric wire W is pulled or the like in a transverse direction, the deflection range is restricted at three sites enclosed by small circles S2, S3, and S4 in the figure. Thus, deflection (also referred to as twist) of the terminal 50 in the inside of the terminal accommodation chamber 14 can be suppressed to a minimal extent. Accordingly, when the connector 1 and the counterpart connector 2 are to be fit to each other, a situation is prevented that the male tab terminal 6 of the counterpart connector 2 violently collides with the terminal 50 of the connector 1 (violently collides at the portion enclosed by the small circle S1). Thus, the terminals 50 and 6 can smoothly be electrically connected to each other. Further, since the three beaks 22 and 23 hold the terminal 50, improvement is achievable in the holding force of the terminal 50.

Further, according to the connector 1, the lance 20 is formed in a plate shape having a wide width because of the three beaks 22 and 23 having been provided. This causes an increase in the rigidity of the lance 20 and hence causes an increase in the insertion resistance at the time of terminal insertion. However, the slits 24 are provided and make easy the elastic deformation of the lance 20. This can suppress the increase in the insertion resistance as much as possible. Further, the tips of the three portions separated in the width direction of the lance 20 by the slits 24 are linked together by the linkage part 25. Thus, in a case that the lance 20 is forcedly warped for the purpose of removing the terminal 50, when the center beak 22 is merely displaced in the engagement separating direction, the other beaks 23 on both sides also can be displaced together in the engagement separating direction. Thus, at the time of terminal removal, it is sufficient to perform the same operation as the conventional case of one beak.

Further, according to the connector 1, the front ends of the three beaks 22 and 23 engage with front hole edges of the individual lock holes 54 and 55 so that the terminal 50 is prevented from moving to the rearward of the connector housing 10 and hence is positioned and held reliably. Further, side end surfaces of the two beaks 23 arranged at both ends in the width direction of the lance 20 engage with side hole edges of the lock holes 55 so that the terminal 50 is reliably restricted such as not to move in the width direction. Furthermore, a setup is employed that the three beaks 22 and 23 are not aligned in line in the width direction of the lance 20. This can effectively prevent twist of the terminal 50.

Further, according to the connector 1, the beaks 23 arranged at both ends in the width direction of the lance 20 are formed longer in the frontward and rearward directions of the lance 20 than the beak 22 arranged in the center in the width direction. Thus, the terminal 50 can be supported such as not to deviate in a transverse direction by the side surfaces of the longer beaks 23 and hence the effect of side surfaces support for the terminal 50 can be increased so that the twist can be prevented reliably. That is, the holding attitude for the terminal 50 can be maintained appropriate and hence, as shown in FIGS. 13A and 13B, the male tab terminal 6 of the counterpart connector 2 can reliably be prevented from violently colliding with the front end of the terminal 50 of the connector 1.

Here, the present invention is not limited to the embodiment described above and modifications, improvements, and the like may be made appropriately. In addition, the construction material, the shape, the dimension, the number, the arrangement position, and the like of each component in the embodiment described above may be arbitrary and is not limited as long as the present invention can be achieved.

The present invention has been described above in detail with reference to a particular embodiment. However, it is clear for the person skilled in the art that various changes and corrections may be made without departing from the spirit and the scope of the present invention.

According to the present invention, the three beaks arranged and aligned in the width direction of the lance lock the terminal such as not to drop out to the rearward of the connector housing. Thus, even in a case that a twisting force in the right and left directions acts on the terminal when the electric wire is pulled or the like in a transverse direction, deflection (also referred to as twist) of the terminal in the inside of the terminal accommodation chamber can be suppressed to a minimal extent. Thus, at the time that the connector and the counterpart connector are fit to each other, a situation is prevented that the male tab terminal of the counterpart connector violently collides with the terminal of the connector. Thus, the terminal can smoothly be electrically connected to each other. Further, since the three beaks hold the terminal, improvement is achievable in the holding force of the terminal.

The present invention having such effects is useful in the industrial field of connectors.

Here, the features of the embodiment of the connector according to the present invention described above are briefly listed in the following [1] to [5].

[1] There is provided a connector (1) including a connector housing (10) and a terminal (50) attached to a tip of an electric wire (W) and accommodated and held in the inside of the connector housing (10), wherein the connector housing (10) includes: a terminal accommodation chamber (14) into which the terminal (50) is inserted from a rearward of the terminal accommodation chamber (14); a stopper (15) configured to, when a front end of the terminal (50) is inserted into the terminal accommodation chamber (14) from the rearward thereof, abut against the front portion of the terminal, and position and lock the terminal (50) so as to prevent frontward movement of the terminal; and a flexible lance (20) configured to, when the terminal (50) is inserted into the terminal accommodation chamber (14) from the rearward thereof, be pushed by the terminal (50) so as to be temporarily deformed to the outer side of an insertion path for the terminal (50), then, at a stage that the terminal (50) has been inserted to a position determined by the stopper (15), and be restored from the deformation state so that beaks (22, 23) engage with lock holes (54, 55) of the terminal (50), thereby positioning and locking the terminal (50) so as to prevent rearward movement of the terminal, wherein a front portion of the terminal (50) is provided with a flattened-rectangular tube-shaped box part (51) configured to, when a male tab terminal (6) of a counterpart connector (2) has entered from a frontward of the connector housing (10), receive and then go into contact with the male tab terminal (6); and wherein the lock holes (54, 55) are provided respectively at three parts of a center in a width direction and vicinities of both ends in the width direction of wide-width peripheral walls constituting the box part (51); wherein the three beaks (22, 23) engaging respectively with the lock holes (54, 55) at the three parts of the terminal (50), protrude from the lance (20).

[2] The connector (1) according to the above-mentioned [1], wherein: the lance (20) is formed in a shape of one plate having a wide width corresponding to a width dimension of the box part (51) of the terminal (50); the three beaks (22, 23), engaging respectively with the lock holes (54, 55) at the three parts of the terminal (50), protrude from a wide-width surface of the plate-shaped lance (20); in the lance (20), slits (24) for improving elasticity of the lance (20) are formed along frontward and rearward directions of the lance so as to be located between the beaks (23) arranged at both ends in the width direction of the lance (20) and the beak (22) arranged in the center in the width direction; and tips of three portions separated in the width direction of the lance (20) by the slits (24) are linked together by the linkage part (25).

[3] The connector (1) according to the above-mentioned [1] or [2], he beaks are constructed such that the positions of the beaks (23) arranged at both ends in the width direction of the lance (20) and the position of the beak (22) arranged in the center in the width direction deviate from each other in the frontward and rearward directions of the lance; front ends of the three beaks (22, 23) engage with front hole edges of the individual lock holes (54, 55); and at least side surfaces of the beaks (23) arranged at both ends in the width direction engage with side hole edges of the lock holes (55).

[4] The connector (1) according to the above-mentioned [3], wherein the beaks (23) arranged at both ends in the width direction are formed longer in the frontward and rearward directions of the lance than the beak (22) arranged in the center in the width direction.

[5] The connector (1) according to any one of the above-mentioned [1] to [4], including: a front holder (70) configured to be attached to the inside of the connector housing (10) from the frontward thereof, wherein the front holder (70) is configured to be pushed into the connector housing (10) from a temporary lock position on a near side in a mounting direction of the front holder (70) to a completely lock position on a far side in the mounting direction of the front holder (70);

wherein the lance is provided in the connector housing (10) such as to prevent a situation that the terminal (50) inserted from the rearward of the connector housing (10) drops out to the rearward thereof in a state that the front holder (70) is located at the temporary lock position; and wherein the front holder (70) is provided with a lance pressing part (78) configured to, in a state that the terminal (50) is locked by the lance (20), when the front holder (70) is pushed in from the temporary lock position to the completely lock position, enter a deformation space (28) of the lance (20) so as to inhibit deformation of the lance (20) and thereby double-lock the terminal (50).

What is claimed is:

1. A connector comprising:

a connector housing; and a terminal attached to a tip of an electric wire and accommodated and held in an inside of the connector housing, wherein the connector housing includes:

a terminal accommodation chamber into which the terminal is inserted from a rearward of the terminal accommodation chamber;

a stopper configured to, when a front portion of the terminal is inserted into the terminal accommodation chamber from the rearward thereof, abut against the front portion of the terminal and position and lock the terminal so as to prevent frontward movement of the terminal; and a flexible lance that comprises three beaks and is configured to, when the terminal is inserted into the terminal accommodation chamber from the rearward thereof, be pushed by the terminal so as to be temporarily deformed to an outer side of an insertion path for the terminal, then, at a stage that the terminal has been inserted to a position determined by the stopper, and be restored from the deformation state so that the three beaks engage with lock holes of the terminal, thereby positioning and locking the terminal so as to prevent rearward movement of the terminal, wherein a front portion of the terminal is provided with a flattened-rectangular tube-shaped box part configured to, when a male tab terminal of a counterpart connector has entered from a frontward of the connector housing, receive and then go into contact with the male tab terminal;

wherein the lock holes are provided respectively at three parts of a center in a width direction and vicinities of both ends in the width direction of wide-width peripheral walls constituting the box part;

wherein the three beaks, engaging respectively with the lock holes at the three parts of the terminal, protrude from the lance.

2. The connection connector according to claim 1, wherein the lance is formed in a shape of one plate having a wide width corresponding to a width dimension of the box part of the terminal;

wherein the three beaks, engaging respectively with the lock holes at the three parts of the terminal, protrude from a wide-width surface of the plate-shaped lance;

wherein in the lance, slits for improving elasticity of the lance are formed along frontward and rearward directions of the lance so as to be located between the beaks arranged at both ends in the width direction of the lance and the beak arranged in the center in the width direction; and wherein tips of three portions separated in the width direction of the lance by the slits are linked together by the linkage part.

3. The connector according to claim 1, the beaks are constructed such that the positions of the beaks arranged at both ends in the width direction of the lance and the position of the beak arranged in the center in the width direction deviate from each other in the frontward and rearward directions of the lance; front ends of the three beaks engage with front hole edges of the individual lock holes; and at least side surfaces of the beaks arranged at both ends in the width direction engage with side hole edges of the lock holes.

4. The connector according to claim 3, wherein the beaks arranged at both ends in the width direction are formed longer in the frontward and rearward directions of the lance than the beak arranged in the center in the width direction.

5. The connector according to claim 1, further comprising:

a front holder configured to be attached to the inside of the connector housing from the frontward thereof, wherein the front holder is configured to be pushed into the connector housing from a temporary lock position on a near side in a mounting direction of the front holder to a completely lock position on a far side in the mounting direction of the front holder;

wherein the lance is provided in the connector housing so as to prevent a situation that the terminal inserted from the rearward of the connector housing drops out to the rearward thereof in a state that the front holder is located at the temporary lock position; and wherein the front holder is provided with a lance pressing part configured to, in a state that the terminal is locked by the lance, when the front holder is pushed in from the temporary lock position to the completely lock position, enter a deformation space of the lance so as to inhibit deformation of the lance and thereby double-lock the terminal.

* * * * *